United States Patent [19]

Chapman

[11] Patent Number: 4,690,186

[45] Date of Patent: Sep. 1, 1987

[54] LOG FEED APPARATUS

[75] Inventor: Robert E. Chapman, Surrey, Canada

[73] Assignee: Optimil Machinery, Inc., Delta, Canada

[21] Appl. No.: 836,308

[22] Filed: Mar. 5, 1986

[51] Int. Cl.[4] ..... B02C 7/12; B27C 1/08

[52] U.S. Cl. ..... 144/176; 144/118; 144/220

[58] Field of Search ..... 144/39, 41, 118, 176, 144/220, 162 R, 356, 357, 369, 373; 83/360, 368, 367, 371

[56] References Cited

U.S. PATENT DOCUMENTS

| | | | |
|---|---|---|---|
| 3,190,326 | 6/1965 | Standal | 144/118 X |
| 3,245,442 | 4/1966 | Johnson . | |
| 3,262,476 | 7/1966 | Johnson . | |
| 3,361,167 | 1/1968 | Farnsworth . | |
| 3,542,302 | 11/1970 | Salzmann, Jr. . | |
| 3,627,005 | 12/1971 | Morton . | |
| 3,635,267 | 1/1972 | Reuter . | |
| 3,692,074 | 9/1972 | Nilsson | 144/39 |
| 3,742,993 | 7/1973 | Morton et al. . | |
| 3,812,891 | 5/1974 | Reuter . | |
| 3,814,155 | 6/1974 | Reuter . | |
| 4,266,584 | 5/1981 | Lomnicki . | |
| 4,440,203 | 3/1984 | Ostberg | 144/39 |
| 4,456,045 | 6/1984 | Gregoire . | |

*Primary Examiner*—W. D. Bray

*Attorney, Agent, or Firm*—Kolisch, Hartwell & Dickinson

[57] ABSTRACT

A chipper wherein the rotary head has its rotational axis inclined slightly from being normal relative to a log's transport axis and a stationary guide plate, disposed centrally within the knives in the head, parallels such axis to support the side of a log.

6 Claims, 3 Drawing Figures

LOG FEED APPARATUS

BACKGROUND AND SUMMARY OF THE INVENTION

The present invention relates to chipper apparatus, and more particularly to an improved chipper-head structure which affords both maximum desired guidance of a log as it passes through a chipping station, and positioning of a rotary chipper head in a manner which eliminates undesirable "back cutting".

Over the years, many improvements have been made in wood-processing equipment to maximize commercial yields from logs. One such improvement is the well-known chipper head which produces a planar surface along a side of a log, with usable chips removed from the periphery of a log.

Considerations which are especially important, relative to the efficient performance of a chipper head, are (1) that it produce a smooth, uniform surface on the face of a chipped log, and (2) that a log, as it passes such a head, be well supported so that it doesn't "chatter" or "wander".

While there are many commercially available chipper-head structures that do reasonably well at achieving these ends, those in the industry recognize that there is still much room for improvement. For example, where a chipper head is oriented to produce a "cutting plane" which parallels a log's transport path through a chipper, a frequent problem is one referred to above as "back cutting"—a phenomenon resulting from the fact that, during the downstream sweep of a chipper-head's knives, the knives recontact the log's now-flat surface, marring it, and thereby removing material which should not be removed.

An important approach to eliminating the problem of back cutting has been to position a chipper head with its cutting plane at a slight angle relative to a log-transport path so that the upstream sweep of its knives produces the desired chipping and surface-facing action, but also so that the downstream sweep results with a knife distanced from the passing log surface. Here, however, the problem has existed of how adequately to support the face of a log against chatter, etc., where only the lead, or upstream, portion of a chipper head contacts a log.

A general object, therefore, of the present invention is to provide unique chipper apparatus which takes care of these considerations and difficulties in a highly effective and simple manner.

More particularly, an object of the invention is to provide such apparatus wherein a rotary chipper head is so mounted that, when rotating, its knives define a cutting plane which is at a slight angle (downstream divergent) relative to the transport path of a log through the apparatus, with guide structure also provided, centrally relative to the rotary axis of the head, defining a guide plane which substantially parallels the log-transport path.

According to a preferred embodiment of the invention, a rotary chipper head, carrying the usual complement of chipper knives, is secured to one end of a hollow shaft which is journaled for rotation within a casing that is mounted on the frame of the apparatus. The mounting thus provided for the head is such that, when the head is rotated, the knives define a cutting plane which is at a slight angle (downstream divergent) relative to the transport path provided for a log through the apparatus. The axially outermost extremities of the knives, i.e. those ends which are closest to the transport path, describe what is referred to herein as a circularly bounded cutting expanse which is centered on the rotary axis of the head.

Supported on bearing structure within the hollow interior of the chipper-head shaft is a nonrotary shaft having one end anchored suitably to the apparatus frame, and its opposite end disposed within the chipper head for carrying a special guide plate. The guide plate herein described is circular (as viewed along the rotary axis of the head), and when viewed as one would see it looking down (in plan) on the log-transport path, has a wedge-shaped configuration. The perimeter of the guide plate lies within the circular boundary of the cutting expanse, and the face of the plate occupies and defines what is referred to herein as a "guide plane" which substantially parallels the log-transport path.

While, to suit different operating circumstances, the cutting plane and the guide plane can be arranged to intersect one another at different chosen locations, as will be explained below, in the preferred embodiment, these planes in the apparatus illustrated and described herein are arranged so that they intersect adjacent the most upstream extremity of the cutting expanse. The guide plate is mounted so that it will not rotate.

The various objects and advantages which are attained by the invention will become more fully apparent as the description given below is read in conjunction with the accompanying drawings.

DETAILED DESCRIPTION OF THE INVENTION

Figure 1:
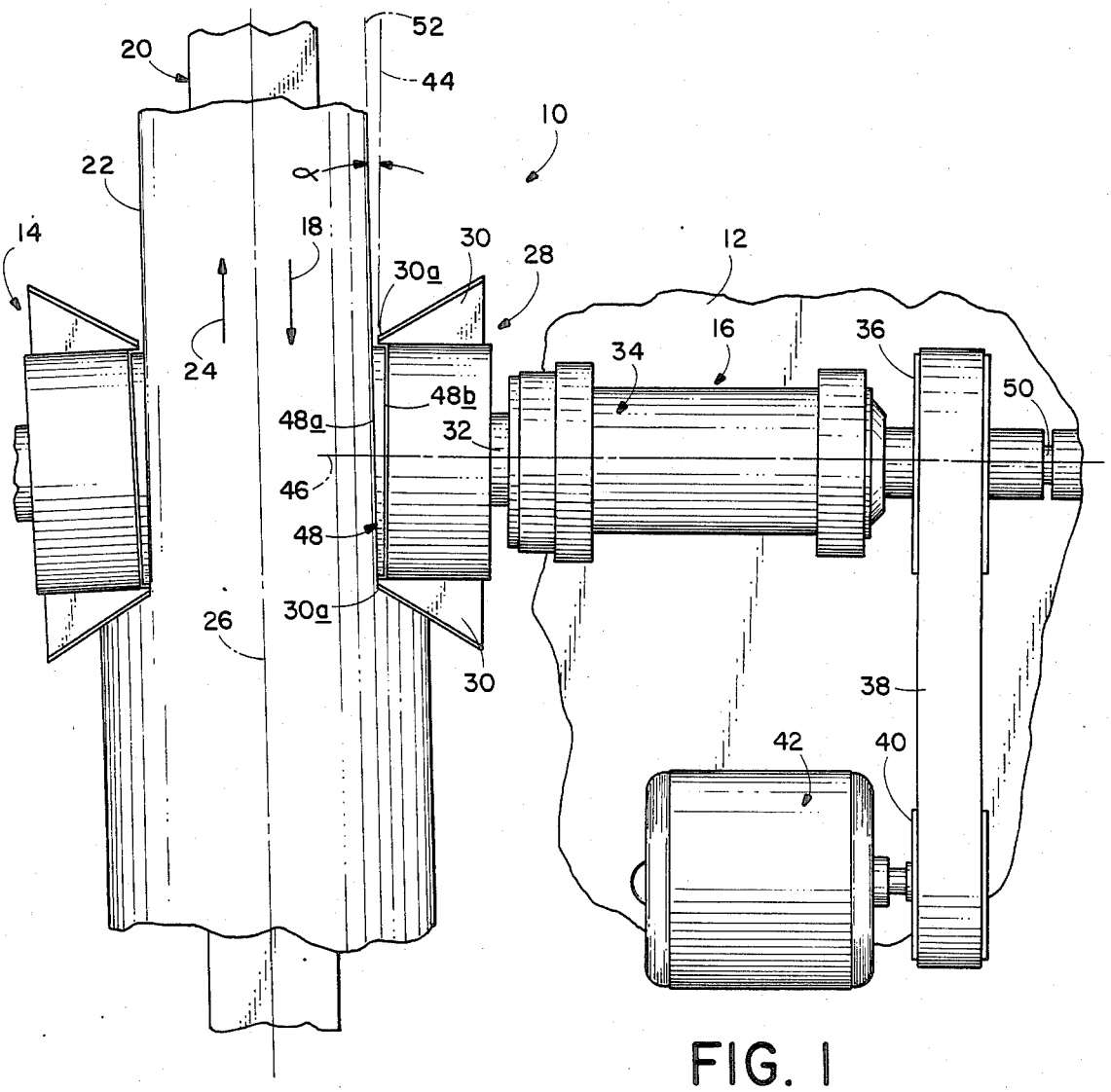
FIG. 1 is a simplified top plan view of a chipper constructed in accordance with the present invention.

Turning now to the drawings, and referring first to FIG. 1, indicated generally at 10 is a chipper constructed in accordance with the present invention. Chipper 10 includes a frame 12 on which are mounted two opposed chipper-head structures 14, 16 which are mirror images of one another, and which define a chipping station shown generally at 18. Also included in the chipper is a conveyor shown in simplified form at 20 which extends through the chipping station for transporting logs, such as log, or workpiece, 22, in the direction of arrow 24 along what is referred to herein as a linear transport path represented by dash-dot line 26. The lower portion of FIG. 1 along conveyor 20 is referred to herein as the upstream side of the chipper, and the upper portion of the figure along the conveyor is referred to as the downstream side of the chipper.

Focussing specifically now on chipper-head structure 16, the same includes a rotary chipper head 28 including the usual complement of circumferentially distributed knives, or knife means, such as the two shown in simplified form at 30. Other knives in head 28 have been removed from the drawing in order to simplify the latter.

Head 30 is anchored to a hollow shaft 32 which is journaled in a casing 34 that is suitably mounted on frame 12. Shaft 32 has a stepped-outside-diameter construction, and extends completely through casing 34 with its right end in FIG. 1 carrying a drive sheave 36. Sheave 36 is connected through a belt 38 to another drive sheave 40 which is carried on the output drive shaft of a motor 42—the latter being suitably secured to frame 12.

Casing 34, and associated structure which will be described shortly, are referred to herein as a chipper-head mounting means. This structure supports head 28 in such a manner that the axially outermost extremities of the knives, such as those shown at 30*a*, with the head rotating, define a cutting plane 44 which is at a slight angle $\alpha$ relative to path 26. Angle $\alpha$ is exaggerated in FIG. 1 in order to illustrate it. Preferrably, this angle is about one degree.

Figure 2:
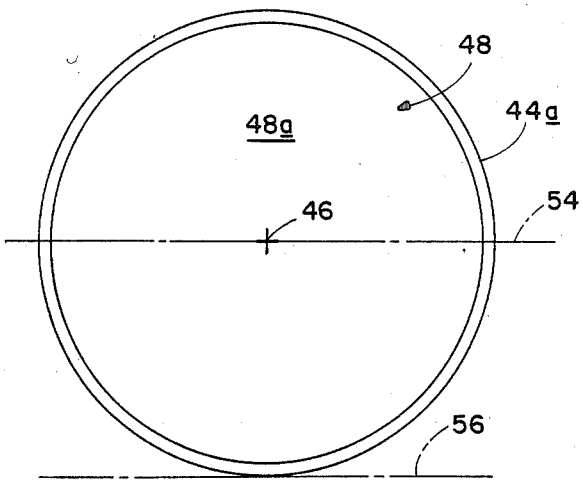
FIG. 2 generally illustrates the relationship which exists between what is referred to herein as a circularly bounded cutting expanse and a full-circular facial expanse, and also the approximate limits for the region wherein what is called a cutting plane and a guide plane preferably intersect.

Turning attention for a moment to FIG. 2 along with FIG. 1, the plane of FIG. 2 is the same as cutting plane 44. When head 28 is rotated, the extremities 30*a* of knifes 30 describe or define what is referred to herein as a circularly bounded cutting expanse 44*a* in plane 44. This cutting expanse is represented by the outer circle in FIG. 2. Expanse 44*a* is concentric with respect to, and disposed normal relative to the rotary axis of head 28 which is shown in the figures at 46.

Forming an important part of chipper-head structure 16 is a circular guide plate, or workpiece guide means, 48 which is secured to a stationary shaft 50 that extends, as will be more fully explained, through the hollow interior of previously mentioned shaft 32. The right end of shaft 50 in FIG. 1, which is the only portion of the shaft shown in this figure, extends beyond the right end of shaft 32, and is suitably anchored to frame 12. Plate 48, accordingly, is a nonrotating member.

Still with reference to FIG. 1, the left face 48*a* of plate 48 is referred to herein as a planar guide surface which defines what is called a vertical guide plane shown by dash-dot line 52. Plane 52 substantially parallels previously mentioned path 26. Face 48*a* is also referred to herein as a full-circular facial expanse. As can be seen in FIGS. 1 and 2, the perimeter of this expanse lies radially within the extremities 30*a* of knives 30. As a consequence, the guide surface formed by plate 48 lies within the perimeter of previously mentioned cutting expanse 44*a*.

While plate 48 may have different specific forms, in the embodiment now being described, the plate, as viewed in FIG. 1, presents a wedge-shaped configuration, with its face 48*b*, which is opposite face 48*a*, substantially paralleling cutting plane 44.

Viewing again FIG. 2 along with FIG. 1, let us consider the relationship between planes 44, 52 vis-a-vis where, preferably, they intersect. This, of course, determines the axial positional relationship between face 48*a* and the extremities 30*a* of the knives. Experience has shown that it is best if the vertical line of intersection between planes 44, 52 be, in its most downstream position, closely adjacent where axis 46 intersects plane 44, and in its most upstream position, closely adjacent the most upstream extremity of cutting expanse 44*a*. The downstream limit just mentioned is suggested in FIG. 2 by dash-dot line 54, and the upstream limit is suggested by dash-dot line 56. In the construction illustrated herein, the line of intersection of planes 44, 52 is substantially at the location of line 56. This has been found to be the most satisfactory location for most operating conditions.

Figure 3:
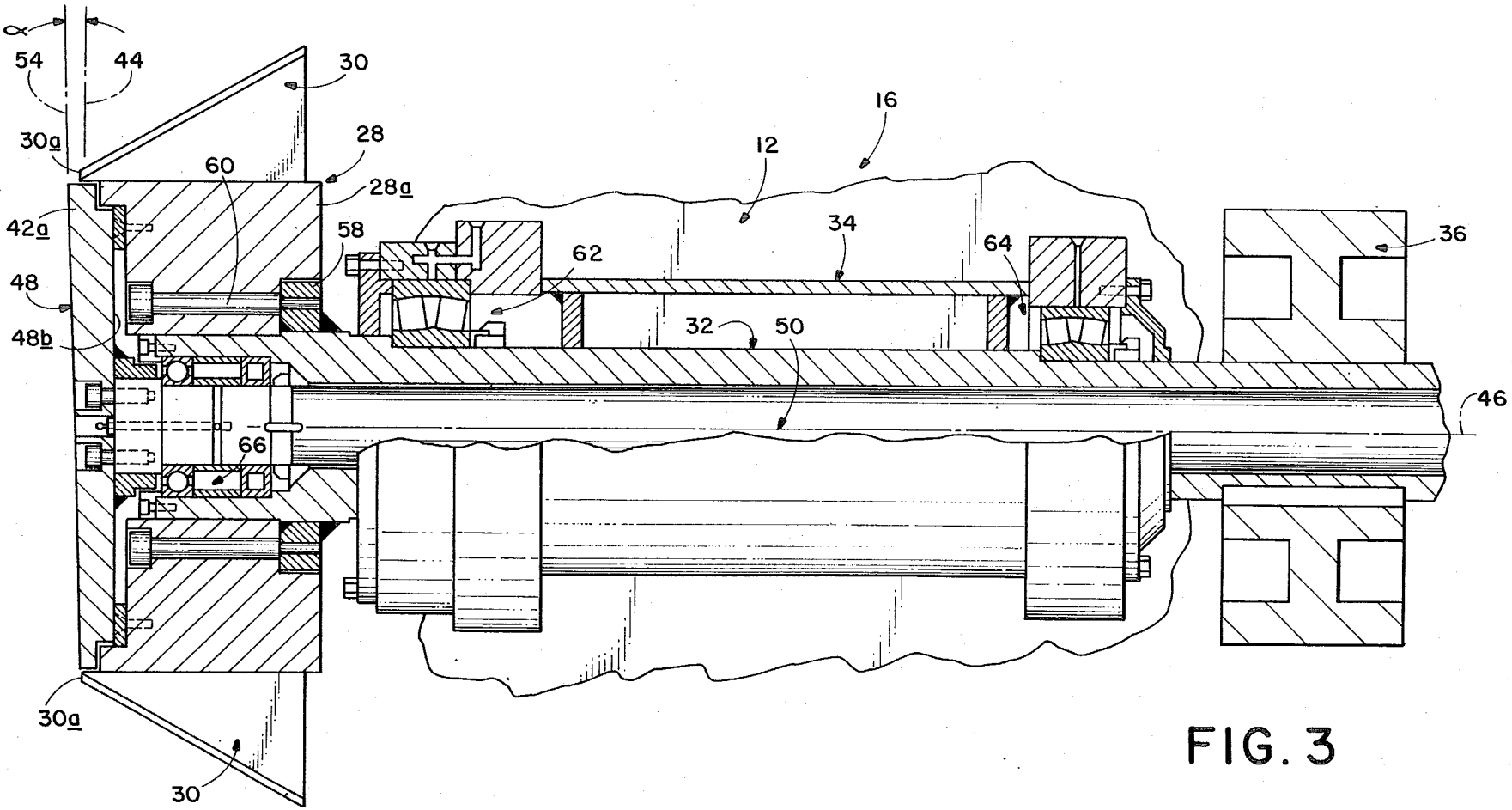
FIG. 3 is an enlarged fragmentary top sectional view illustrating details of construction of one chipper-head structure in the chipper of FIG. 1.

Addressing now FIG. 3, this illustrates details of construction of chipper-head structure 16. Those familiar with this field will easily understand the structural components, and their relationships, shown in FIG. 3, and, accordingly, only key features will be discussed generally in the description which now follows.

Head 28 includes an annular hub 28*a* which is anchored to a ring 58 on shaft 32 through bolts, such as bolt 60. Knives 30, which, in FIG. 3 as in FIG. 1, are shown in simplified form, are conventionally secured to the outer circumference of hub 28*a*.

Shaft 32 is supported within casing 34 through axially-spaced bearing assemblies such as those shown at 62, 64. Suitably provided on axially opposite sides of assemblies 62, 64 is conventional lubricant seal structure which allows for contained lubrication of the assemblies. Naturally, casing 34 is anchored to frame 12 in a manner assuring that cutting plane 44 is at the proper angle $\alpha$ relative to guide plane 52 which should parallel transport path 26.

Plate 48 is secured as by bolting to the left end of shaft 50 in FIG. 3, which end is supported within the left end of shaft 32 through a suitable bearing structure, such as bearing structure 66. As was mentioned earlier, the right end of shaft 50 in the figure extends axially beyond the right end of shaft 32, and is suitably anchored to frame 12.

It should be apparent now how the objects sought to be achieved by the present invention are in fact accomplished. Because of the fact that cutting plane 44 occupies a slight, downstream-divergent angle relative to transport path 26, only is it during the upstream sweep of knives 30 that the knives contact a log. Accordingly, downstream- or back-cutting does not occur. Face 48*a* in plate 48 provides a sure, nonrotary guide surface for a log passing through the cutting station, and this eliminates the possibility of a log's chattering or wandering as it passes through the station.

Obviously, the structure proposed by the invention is extremely simple, and this tends to minimize cost of construction, and to maximize performance reliability.

Clearly, different kinds of workpiece guide structures can be used in place of a full-circular plate, such as plate 48. For example, there might be an application where one would wish to define guide plane 52 through a pair of spaced guide rollers disposed within the perimeter of cutting expanse 44*a*. Other variations are, of course, possible.

Accordingly, while a preferred embodiment of the invention, and one suggested modification, have been described herein, other variations and modifications are possible which come within the scope of the invention.

It is claimed and desired to secure by Letters Patent:

1. In a chipper having means defining therethrough a linear transport path for a workpiece, and a rotary chipper head disposed adjacent such path including knife means which, with rotation of the head, defines a cutting plane including a circularly bounded cutting expanse, means mounting such head for rotation in a manner whereby the knife means' cutting plane is disposed at an angle relative to the transport path, and nonrotating workpiece guide means having a planar guide surface located within the boundary of the cutting expanse, with the plane (guide plane) of said guide surface substantially paralleling the transport path.

2. The structure of claim 1, wherein, relative to the direction of movement of a workpiece along the transport path, the guide plane and the cutting plane diverge progressing therealong in a downstream direction, with downstream portions of the cutting plane being further from the transport path than upstream portions thereof.

3. The structure of claim 2, wherein the guide plane and the cutting plane have a line of intersection disposed no further downstream, relative to the upstream portion of the cutting plane, than closely adjacent the point at which the axis of rotation of the chipper head intersects the cutting plane.

4. The structure of claim 2, wherein the guide plane and the cutting plane have a line of intersection, relative to the upstream portion of the cutting plane, no further upstream than closely adjacent the most upstream extremity of the cutting expanse.

5. The structure of claim 3, wherein the guide plane and the cutting plane have a line of intersection, relative to the upstream portion of the cutting plane, no further upstream than closely adjacent the most upstream extremity of the cutting expanse.

6. The structure of claims 2, 3, 4, or 5, wherein said guide surface is circular, with a full-circular facial expanse having a perimeter spaced closely adjacent the boundary of the cutting expanse.

* * * * *